United States Patent [19]

Bennett

[11] 4,189,703

[45] Feb. 19, 1980

[54] SYSTEM FOR DEPLOYING A SENSOR ARRAY FROM TRANSITING VESSEL

[75] Inventor: Derek J. Bennett, Thousand Oaks, Calif.

[73] Assignee: Bunker Ramo Corporation, Oak Brook, Ill.

[21] Appl. No.: 876,906

[22] Filed: Feb. 13, 1978

Related U.S. Application Data

[63] Continuation-in-part of Ser. No. 777,167, Mar. 14, 1977, abandoned.

[51] Int. Cl.[2] ..... B63B 21/56

[52] U.S. Cl. ..... 367/134; 114/254; 9/8 R

[58] Field of Search ..... 114/244, 245, 253, 254; 340/3 T, 2, 8 S, 5 R; 9/8 R

[56] References Cited

U.S. PATENT DOCUMENTS

| | | | |
|---|---|---|---|
| 3,460,058 | 8/1969 | Taplin | 340/2 |
| 3,605,492 | 9/1971 | Stohrer et al. | 9/8 R |

FOREIGN PATENT DOCUMENTS

| | | | |
|---|---|---|---|
| 728451 | 2/1966 | Canada | 340/2 |

*Primary Examiner*—Richard A. Farley

*Attorney, Agent, or Firm*—F. M. Arbuckle; A. Freilich

[57] ABSTRACT

A system for deploying a vertical linear sensor array from a transiting vessel comprising a tubular deployment case closed at the bottom by a descent weight that is connected to a plurality of sensors packed in the case and connected in sequence by a cable of signal wires to a unit for creating drag in the descent of the deployment case and sensors, such as a collapsed parasol-type drogue or a buoyant body. Stacked over the telemetering unit is a cable dispenser open at the bottom and closed at the top by a nose weight. A substantial length of signal cable is coiled in the cable dispenser to pay out from the center with one end connected to the nose weight and the other connected to transmit sensor signals. A toroid core around the signal cable where it is being payed out inductively couples sensor signals to a signal line connected to an inner conductor of an armored cable. The latter is originally coiled in the deployment case over the nose weight of the cable dispenser and is connected to the cable dispenser a short distance from the nose weight. The free end of the armored cable is connected to the vessel.

25 Claims, 12 Drawing Figures

FIG. 7
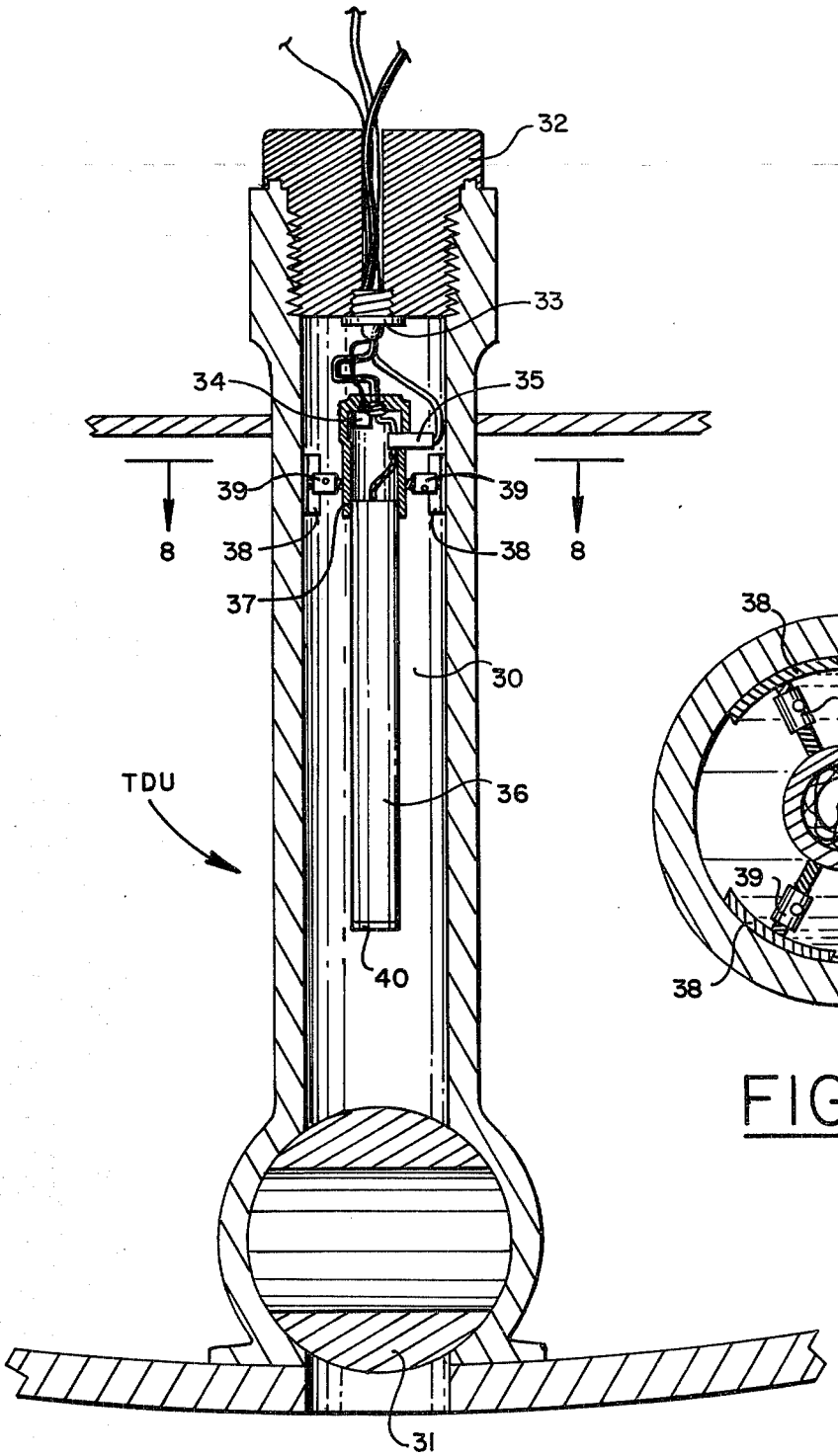
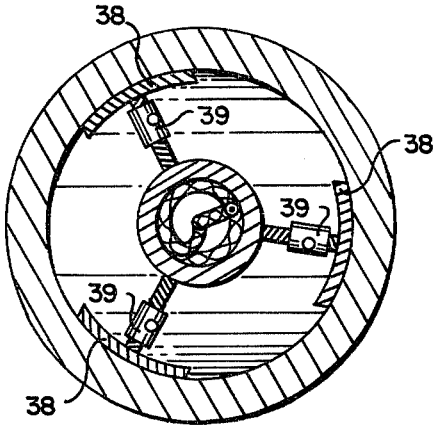
FIG. 8

SYSTEM FOR DEPLOYING A SENSOR ARRAY FROM TRANSITING VESSEL

This is a continuation in part of application Ser. No. 777,167 filed Mar. 14, 1977, abandoned.

BACKGROUND OF THE INVENTION

This invention relates to a system for deploying a vertical linear array of sensors (e.g., hydrophones) from a transiting surface or subsurface vessel, and more particularly to a system for deploying an expendable array of sensors.

Hydrophones are widely used for passively localizing sound waves from subsurface targets. A typical hydrophone system consists of a linear array of hydrophones connected to a telemetering unit that is in turn connected by a signal cable to a submarine, or surface ship. Such an array usually consists of a number of hydrophones suspended in a vertical string and spaced in various sections to form high and low frequency arrays of hydrophones. Normally the top of the array is wired directly to the telemetering unit powered by seawater activated batteries. The telemetry unit processes the acoustic array data for transmission to the submarine or surface ship through a cable comprising at least a single insulated conductor.

In other applications, a vertical linear array of thermocouples, or other temperature sensors, may be deployed to determine gradient temperatures of a body of water.

In either the case of localizing sound waves from a target or in determining temperature gradients, the spacing between the elements of the array must be maintained in a vertical line. There is a natural problem in achieving a stable vertical line of sensors due to shear currents and the vertical length of the array. The top of the array will be affected by higher currents than would be the bottom of the array. The result is that the top section tends to tow the bottom section, causing distortion and tilt in the array. However, shorter arrays will naturally be less influenced by shear currents, and an array about 65 feet long will be negligibly influenced (distorted and tilted) by currents. Of greater concern is the influence of the deploying submarine or ship. As it continues to transit, it is essential that the array not be towed. It is also essential that the deploying vessel be free to maneuver or change speed without influencing the array while data signals from the hydrophones are processed and displayed for a required period.

OBJECTS AND SUMMARY OF THE INVENTION

An object of this invention is to provide a system for deploying an array of sensors from a transiting vessel without motion of the vessel influencing the array.

A more particular object is to provide a system which deploys a vertical linear array of sensors that slowly descends while the deploying vessel continues to transit without towing the array.

These and other objects of the invention are achieved in a preferred embodiment by a deployment case open at one end and closed at the other by a descent weight, the case having stowed therein a plurality of sensors connected to an array cable. Stowed on top of the sensor is a signal cable dispenser adapted to be towed by a transiting vessel using an armored cable. Attached to the end of the signal cable payed out from the cable dispenser is some drag means, such as a parasol-type drogue or bouyant body, to slow the descent of the vertical array of sensors. Tension is thus produced in the array cable between the descent weight and the drag means to maintain the array in a vertical line. Thus, the drag means slows the sink rate of the array while the descent weight maintains tension on the deployed array to maintain it substantially vertical while it sinks, and while the towed cable dispenser dispenses signal cable. The deployed array thus descends in a fixed position while the vessel continues to transit until all of the signal cable from the cable dispenser is payed out. In the meantime, data signals from the hydrophones are transmitted to the vessel through the signal cable and the tether cable. Once all of the signal cable is payed out, the drag of the array will cause the payed out signal cable to part. Thereafter, the cable dispenser and armored cable are released from the vessel, such as by operation of means for cutting the armored cable.

BRIEF DESCRIPTION OF THE DRAWINGS

FIG. 7 is a sectional view of a trash disposal unit in an submarine with an ejection tube in place for deploying the hydrophonic array system of FIG. 1.

FIG. 8 is a cross-sectional view taken along a line 8—8 of FIG. 7.

DESCRIPTION OF PREFERRED EMBODIMENTS

Figure 1:
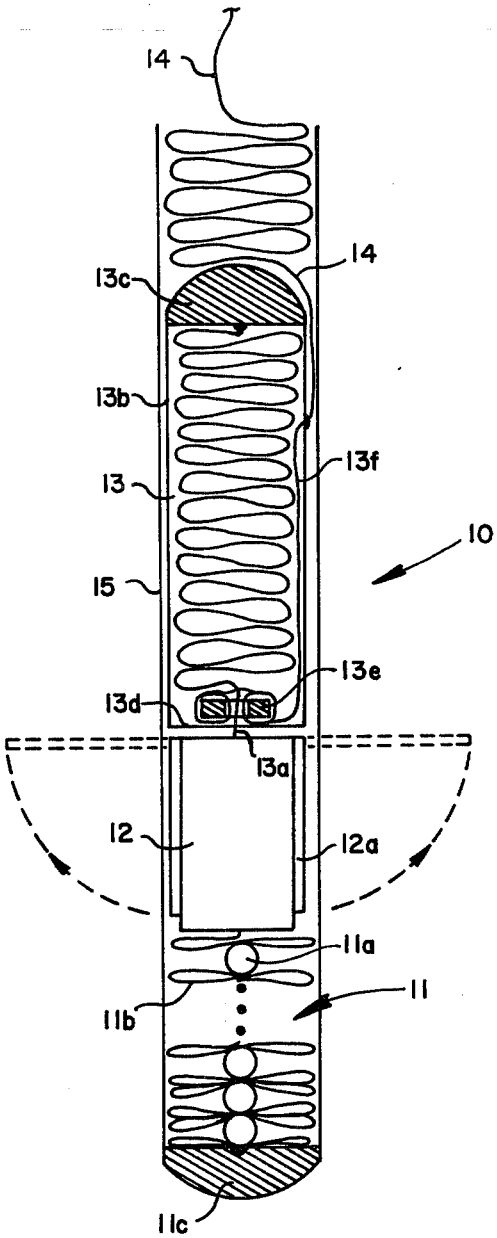
FIG. 1 is a schematic diagram of an expendable vertical sensor array system adapted to be deployed from a transiting vessel.

Referring first to the schematic diagram of FIG. 1, the concept of an expendable vertical hydrophone array assembly adapted to be deployed from a transiting vehicle is achieved by an assembly 10 of three units. At the bottom of the assembly is the first unit 11 comprised of a hydrophone array having a plurality of elements **11*a* connected in sequence by a cable 11*b* to the second unit 12 comprised of telemetering circuits and seawater activated batteries. The second unit also includes a drogue 12*a* fabricated in the manner of a parasol with spring steel ribs and mylar film web. Once the assembly is deployed, the drogue opens to slow the sinking rate of the second unit. At the bottom of the first unit is a descent weight 11*c* connected to the free end of the array cable 11*b***. This weight and the drag of the drogue provide for a tension in the array to extend it and maintain it vertical during its slow descent. This tension minimizes distortion due to shear currents and other disturbances of the water.

Figure 2:
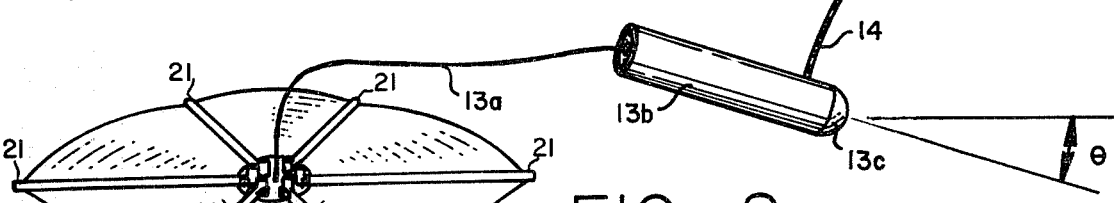
FIG. 2 illustrates the sensor array system of FIG. 1 being deployed.

The top of the array cable 11*b* is directly connected to the telemetering cicuits encapsulated in an epoxy compound. The output of the telemetering circuits is in turn connected to a signal cable 13*a* dispensed by the third unit 13 comprised of a tubular cable dispenser 13*b* closed at the top by a nose weight 13*c* and partially closed at the bottom by an end wall 13*d* having an opening in the center. The cable is preferably wound into a pack with a grease binder to provide a light payout tension from the center of the pack. The outside end of the pack is connected (physically and electrically) to the weight 13*c* which functions as circuit ground for the telemetering signal output. The cable payed out through the end wall 13*d* passes through a torroid core 13*e* as a single-turn primary winding of an output transformer. Data pulses from the telemetering circuits are thus inductively coupled into a mutli-turn secondary winding of a signal line 13*f* having its insulated conductor electrically connected to a conductor in an armored signal cable 14 of length 50 feet coiled into a pack with a silicone rubber binder. The end of the armored cable connects into the side of the cable dispensing case. When the assembly is deployed from a transiting vessel, such as a submarine, the armored cable is payed out from the pack. Once fully payed out, the armored cable tows the assembly. To assure that it tows below the vessel, or at least below the surface of the water, the armored cable is attached to the cable dispenser at a distance from the nose weight 13*c* so that its case assumes an initial attack angle $\theta$, as shown in FIG. 2, that tends to drive the case deeper to clear the hull and propellers of the transiting vessel. Tension of the cable 14 applies countervailing so that the cable dispenser will follow a substantially horizontal path.

The basic requirements for the armored cable are: single insulated conductor with a high strength to diameter ratio for low drag, and a length between 40 and 100 feet. A length of 50 feet of cable having an outer diameter of 32 Mils can be coiled into a pack that is 2.9 inches in diameter and 1.5 inches long.

The three units of the assembly are preferably stowed in a tubular deployment case 15 as shown schematically in FIG. 1 and less schematically in FIG. 2. When the deployment case is released from the submarine while under way at depth, either under the influence of gravity or possibly an ejection charge, the armored cable on top of the nose weight is payed out in about four seconds. When all of the armored cable 14 has been payed out, the cable dispenser 13*b* and the telemetering unit 12 are pulled out of the deployment case 15 which continues to descend while paying out the hydrophone array, as illustrated in FIG. 2. The elapsed time to deploy the array to its full vertical extent is a few seconds. With say 11,000 feet of signal cable 13*a* packed in the towed cable dispenser 13*b* (which is 11.55 inches in length and 2.9 inches in diameter), and a submarine speed of 7 knots, there are 15 minutes available to gather array data as the array descends slowly. Then the payed out signal cable 13*a* parts at a tension of 3 lbs. The cable dispenser 13*b* and armored cable 14 are later discarded by cutting the armored cable.

Figure 3:
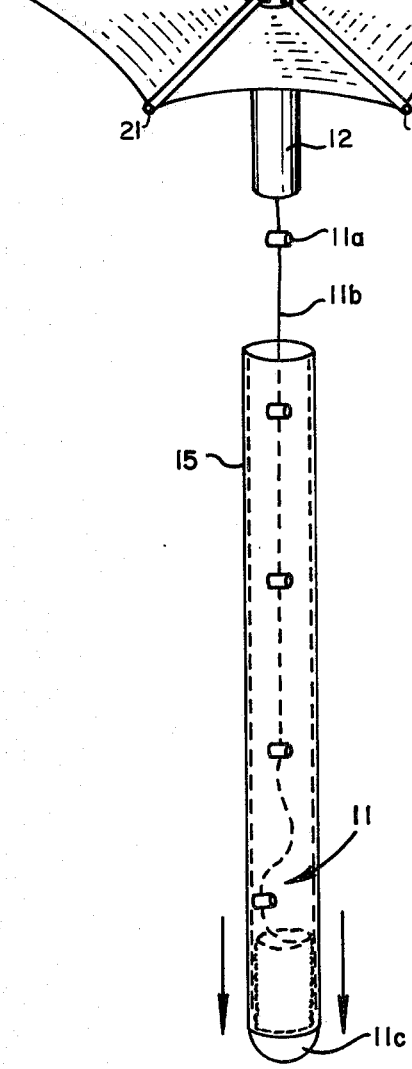
FIGS. 3, 4 and 5 illustrate the manner in which a drogue on a telemetering unit of the system in FIG. 2 is releasably locked onto the signal cable dispensing case.
Figure 3:
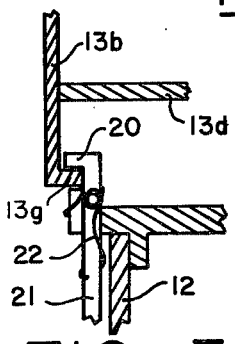
Figure 4:
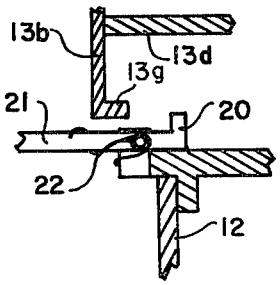
Figure 5:
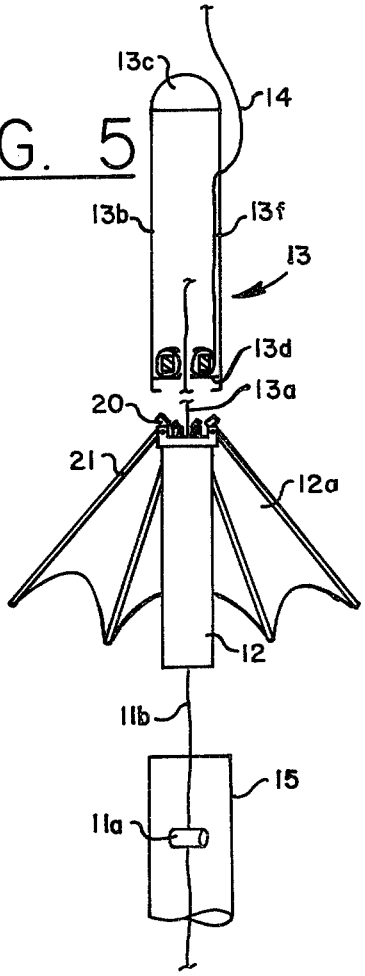

To assure that the armored cable pulls both the signal cable dispenser 33*b* and the telemetering unit 12 out of the deployment case 15, the inner ends 20 of the steel ribs 21 of the drogue are used to lock the telemetering unit onto the case of the cable dispenser 13*b*, as shown in FIG. 3. The end 20 of each rib 21 is turned outwardly to fit over an annular flange 13*g* on the end of the cable dispenser 13*b*. Once the drogue is pulled out of the deployment case 15(FIG. 2), a spring 22 urges the rib outwardly. Water immediately aids the force of the spring to unlock the drogue from the cable dispensing case, and to fully unfold the drogue as shown in FIG. 5 with the end of the rib against the top of the telemetering package, as shown in FIG. 4.

Figure 6:
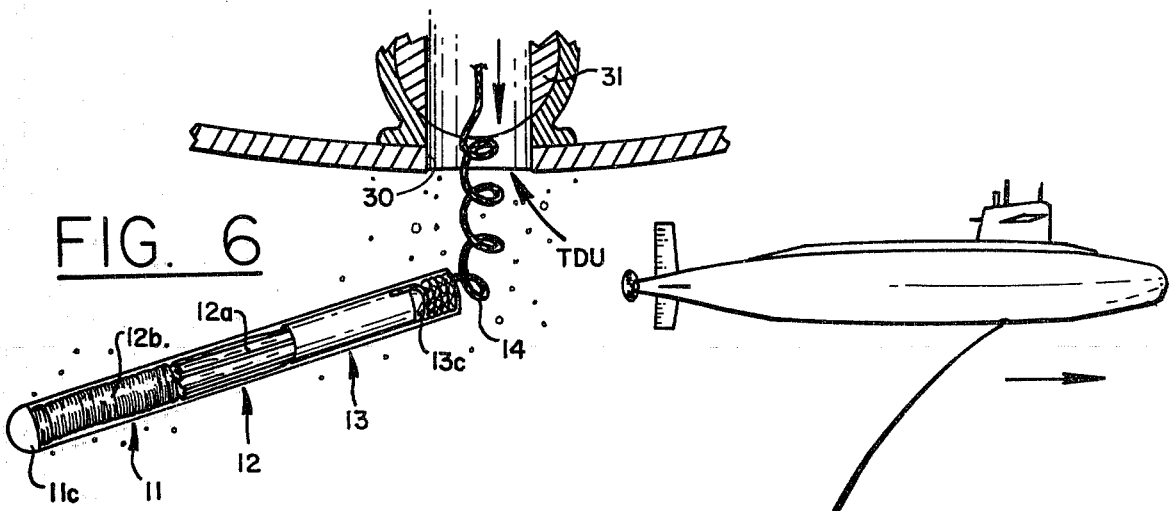
FIG. 6 illustrates the system of FIG. 1 being ejected through a trash disposal valve of a submarine.

In some instances the assembly of FIG. 1 may be deployed from a surface vessel, such as by dropping it from a boom over the side or off the stern of the vessel, but in the usual case, it is deployed from a submerged submarine maneuvering at low speed. A practical way to launch the assembly is to eject it from the trash disposal unit (TDU) of the submarine as shown in FIG. 6. The TDU (located on the center line of the hull and pointing vertically downard) has an inside diameter of about 12 inches and an inside length of from 8 to 12 feet, depending on the class of the submarine. The TDU is therefore ideal for launching a hydrophone array assembly since the outer diameter of the deployment case shown in FIG. 2 need be only 3 inches, and its length need be only three to four feet (typically 39.5 inches).

A sectional view of a full TDU is shown in FIG. 7. The TDU is comprised of a tube 30, a gate 31 and a breach 32. The gate is normally closed, as shown, after the tube has been blown out with compressed air. Once the gate is closed, the breach may be opened to place trash in the tube. In this case the breach is replaced with a special unit which has a fitting 33 threaded into a hole through the center of the breach. The fitting is for the purpose of passing three insulated conductors into the tube, one to function as a hydrophone signal line (i.e., to be connected to the conductor in the armored cable), one to electrically fire a launching squib (pyrotechnic charge) 34, and one to activate a cutter 35 for the armored cable 14 (FIG. 2).

Figure 9:
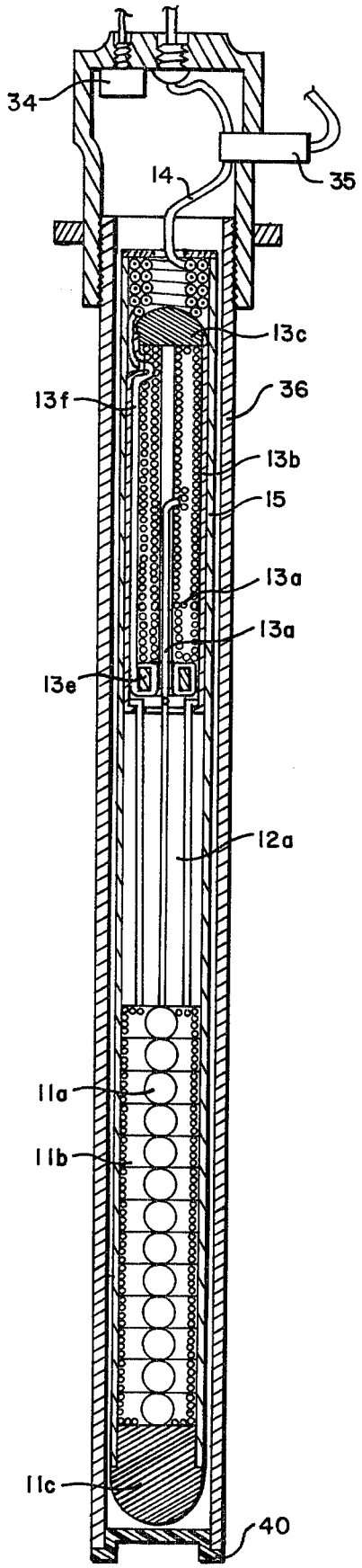
FIG. 9 is a sectional view of a launch tube and the hydrophone array system shown schematically in FIG. 1.

A launch tube 36 is placed in the TDU with a header 37 (shown sectioned) that supports the squib and cable cutter. The hydrophone assembly of FIG. 1 is placed in the launch tube with the packed hydrophone at the bottom and the tether cable at the top as shown in a sectional view of the launch tube 36 in FIG. 9.

The armored cable passes through the cable cutter and the end wall of the header. (The cable cutter may be, for example, an electromagnetically operated guillotine). To support and locate the launch tube and header in the TDU, three pressure plates 38 are pressed against the wall of the TDU with turnbuckles 39, as may be more clearly seen in the cross-sectional view of FIG. 8 taken along a line 8—8 in FIG. 7.

In practice, the launch tube 36 would be used as a storage container for the hydrophone system. This container would have a plastic disc at each end while in storage like a disc 40 shown at the bottom in FIG. 7. When in use, the plastic disc at the top is removed, and after feeding the armored cable through the cutter and the end wall of the header, the container is threaded into the header, thus converting the container into a launch tube. The plastic disc at the bottom of the container is left in place to support the hydrophone assembly until the squib is fired. That disc is blown out with the deployment case by the gas pressure created in the header by detonation of the squib 34.

Figure 10:
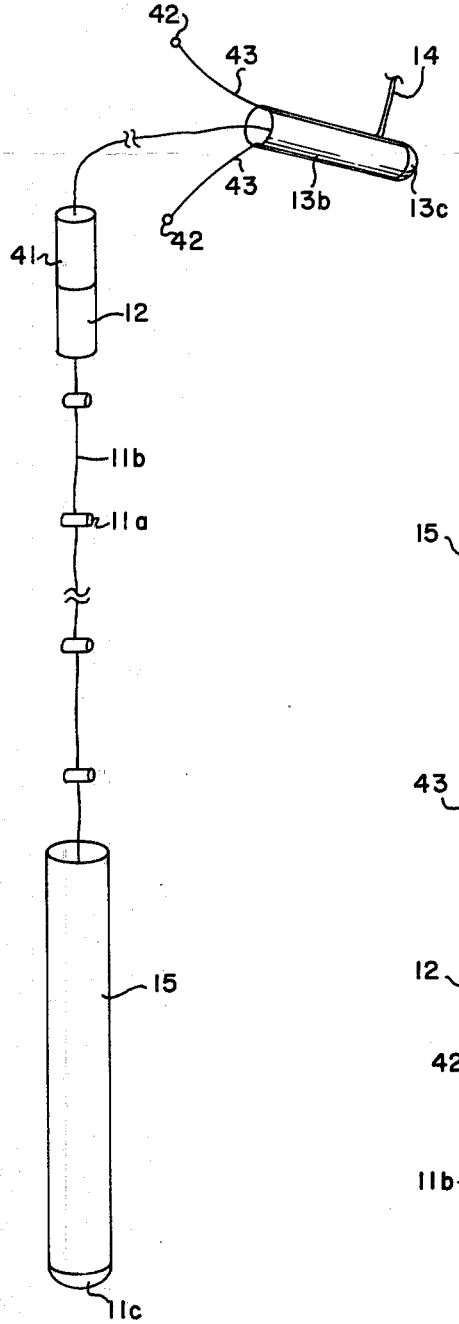
FIG. 10 illustrates a sensor array deployed between a descent weight and a buoyant body.

An alternative means for creating a drag at the upper end of the sensor array (in order to deploy the array, maintain tension on the array cable, and retard the rate of descent) is a buoyant body 41, attached to the unit 12 in lieu of the drogue, as shown in FIG. 10. The buoyant body may be formed of "syntactic" foam comprised of hollow glass microspheres in a plastic matrix molded into the shape of a cylinder. The cylinder is designed to provide a net buoyancy for the complete array that is negative, i.e., a net buoyancy that is given by the difference between the buoyant force and the weight of the array, where the weight is greater than the force.

Figure 11:
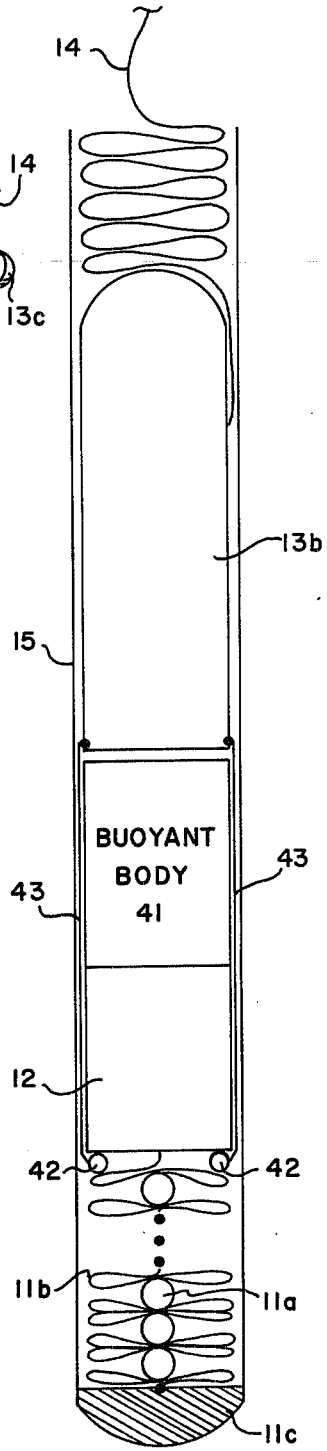
FIG. 11 illustrates schematically the manner in which the buoyant body of FIG. 10 is stowed with lift links and beads for ejection from a deployment case.

In order to extract the buoyant body 41 and the telemetering unit 12 from the deployment case 15, a plurality of beads 42 are connected to the cable dispenser **13*b* by lines 43. The lines are sufficiently long for the beads to be stowed in the deployment case underneath the telemetering unit 12, as shown in FIG. 11. When the armored cable 14 extracts the cable dispenser 13*b* from the deployment case 15, the telemetering unit and buoyant body are extracted because the beads 42** are made too large to slip by the telemetering unit.

Figure 12:
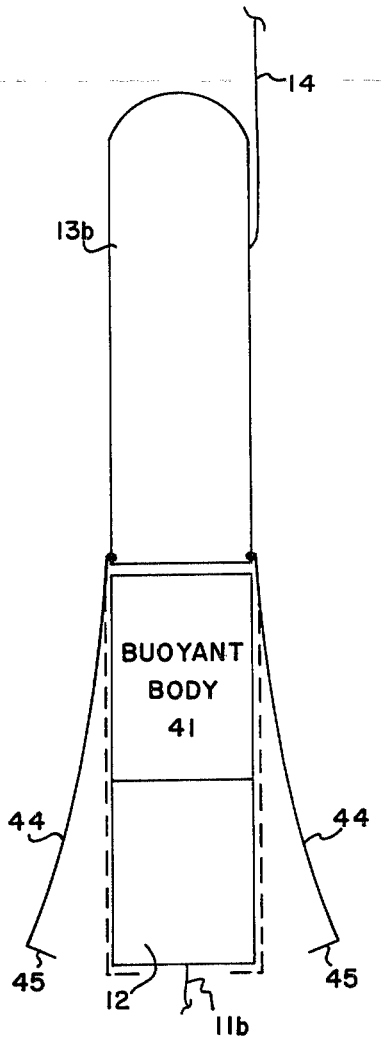
FIG. 12 illustrates an alternate scheme for ejecting a buoyant body from a deployment case.

FIG. 12 shows an alternative for connecting the telemetering unit 12 and the buoyant body 41 to the cable dispenser **13*b* in such a way that they are released as soon as they have been extracted from the deployment case 15. This alternative is comprised of curved springs 44 attached to the cable dispenser 13*b* in lieu of the beads and lines. The springs are curved out away from the buoyant body and telemetering unit, and turned sharply in at the ends 45 as shown so that when stowed in the deployment case, the springs will be straight along side the buoyant body and telemetering unit with the turned-in ends underneath the telemetering unit as shown in dotted lines. Once the telemetering unit 12 is extracted from the deployment case 15 (not shown in FIG. 12), the springs 44 resume their curved shape to move the turned-in ends 45 out from underneath the telemetering unit 12, thus releasing the buoyant body 41 and telemetering unit 12 from the cable dispenser 13*b***.

Although only two extracting means for the buoyant body 41 and telemetering unit 12 are shown connected to the cable dispenser **13*b*** in these two exemplary embodiments, it is to be understood that a greater number could, in practice, be provided. For example, three such means equally spaced would greatly reduce any tendency for the buoyant body and telemetering unit to be counted in the deployment case while being extracted.

Although particular embodiments of the invention have been described and illustrated herein, it is recognized that modifications and variations may readily occur to those skilled in the art. It is therefore intended that the claims be interpreted to cover such modifications and variations.

The embodiments of the invention in which an exclusive property or privilege is claimed are defined as follows:

1. A system for vertically deploying a sensor array in a body of water from a transiting vessel comprising:

a sensor array including a plurality of sensors interconnected by a flexible connecting cable;

a descent weight physically connected to a first end of said array;

a drag means physically connected to a second end of said array;

means for releasably holding said drag means and descent weight in close proximity to one another;

a length of flexible signal cable physically coupled to said drag means and operatively connected to said plurality of sensors;

cable dispensing means for storing said length of signal cable;

a towing cable connected to said cable dispensing means for towing said means from said transiting vessel;

said cable dispensing means including means for paying out signal cable therefrom to thus enable said descent weight to descend and pull said drag means and sensor array away from said cable dispensing means as said dispensing means is towed by said transisting vessel; and means for releasing said holding means to enable said descent weight and drag means to vertically separate to extend said sensor array as they descend.

2. A system as defined in claim 1 including a tubular deployment case having said descent weight at one end with said plurality of sensors and connecting cable packed in said case over said weight with said drag means over said packed sensors, and said cable dispensing means is stowed in said deployment case over said drag means.

3. A system as defined in claim 2 wherein said drag means is a parasol-type drogue.

4. A system as defined in claim 3, wherein said parasol-type drogue is comprised of ribs hinged from a rigid body and flexible material taut between said ribs when fully extended to a position substantially normal to the surface of said rigid body, a spring connected to each rib to force the rib to pivot away from the surface of said rigid body once said rigid body exits said deployment case, and means for preventing each of said ribs from pivoting away from said surface more than about 90°.

5. A system as defined in claim 4 wherein at least one of said ribs is provided at the inner end thereof with means for latching onto said cable dispensing means until extended at least partially to said fully extended position.

6. A system as defined in claim 2 wherein said drag means is a buoyant body.

7. A system as defined in claim 6 wherein said buoyant body is connected to a rigid body, and said sensor connecting cable is connected to said rigid body, and wherein said means for coupling said drag means to said cable dispensing means while in said deployment case is comprised of a plurality of flexible lines connected to said cable dispensing means and extending along the sides of said buoyant body and rigid body, each line terminating with a bead too large to slip between said rigid body and said deployment case, whereby extracting said cable dispensing means from said deployment case extracts said buoyant body and rigid body.

8. A system as defined in claim 6 wherein said buoyant body is connected to a rigid body, and said sensor connecting cable is connected to said rigid body, and wherein said means for coupling said drag means to said cable dispensing means while in said deployment case is comprised of a plurality of curved springs attached to said cable dispensing means, said springs extending flat along side of said buoyant body and rigid body while stowed in said deployment case, and said springs being turned in underneath said rigid body, whereby extracting said cable dispensing means from said deployment case extracts said buoyant body and rigid body.

9. A system as defined in claim 2 wherein said towing cable is packed over said dispensing means in said deployment case, whereby said towing cable is payed out from said case upon said case being launched from said vessel.

10. A system as defined in claim 9 including a tubular launching means for launching said deployment case into said body of water under gas pressure.

11. A system as defined in claim 1 wherein said cable dispensing means is comprised of a tubular case closed at one end and open at the other, said tubular case being packed with said cable in a coil for paying out from the center through the opening in the other end.

12. A system as defined in claim 11 including a weight at said closed end of said tubular cable dispensing case, and wherein said towing cable is attached to said tubular cable dispensing case at a point some distance from said weight, whereby said tubular case is towed through said body of water with a downward attack angle.

13. A system as defined in claim 1 including a toroid core surrounding said cable at said opening of said tubular case and an insulated conductor wound around said core, said wound insulated conductor being connected to said insulated conductor of said towing cable, whereby telemetering signals on said signal cable are inductively coupled through said toroid core and wound insulated conductor into said insulated conductor of said towing cable.

14. A system for deploying from a transiting vessel a plurality of sensors in a vertical linear array suspended from a slowly descending telemetering unit comprising a tubular deployment case closed at one end and open at the other end with a descent weight at said one end, and said telemetering unit stowed in said deployment case, a plurality of said sensors connected between said descent weight and said telemetering unit by a sensor array cable of signal wires with one end of said sensor array cable being attached to said descent weight, and said sensors being attached at spaced intervals to said sensor array cable for transmission of signals through signal wires thereof to said telemetering unit, said sensors and cable of signal wires being stowed in said deployment case between said telemetering unit and said descent weight, a tubular cable dispenser stowed in said deployment case between said telemetering unit and the open end of said deployment case, said cable dispenser being closed at one end next to the open end of said deployment case and open at the other, and having stored therein a substantial length of signal cable to be payed out as said telemetering unit separates from said cable dispenser, one end of said cable being connected to said telemetering unit and the other end being connected to said cable dispenser, a drag means connected to said telemetering unit and coupled to said cable dispenser while stowed in said deployment case, and an armored signal cable stored in said deployment case over said closed end of said cable dispenser, one end of said armored signal cable being attached to said transiting vessel and the other end being attached to said cable dispenser to tow said cable dispenser, said armored signal cable being coupled to said signal cable in said cable dispenser for transmitting signals from said telemetering unit to said transiting vessel.

15. A system as defined in claim 14 wherein said one end of said cable dispenser is weighted and said armored towing cable is connected to said cable dispenser at a point away from said one end, whereby said cable dispenser is towed with the one end depressed to provide an attack angle which will assure that the towed cable dispenser remains submerged.

16. A system as defined in claim 14 wherein said armored signal cable is coupled to said signal cable payed out from said cable dispenser by a toiroid core surrounding said signal cable at the open end of said cable dispenser and an insulated signal line having a plurality of turns around said core, said signal line being connected to said armored signal cable.

17. A system as defined in claim 14 wherein said signal cable stored in said cable dispenser is selected to have a tensile strength less than the combined drag of said drag means and deployed sensor array, whereby said signal cable parts in order for the telemetering unit and sensor array to be separated from said transiting vessel after all signal cable has been payed out from said cable dispenser.

18. A system as defined in claim 17 including means for cutting said armored signal cable loose from said transiting vessel after said signal cable has parted.

19. A system as defined in claim 14 including a tubular launching means for launching said deployment case into said body of water under gas pressure.

20. A system as defined in claim 14 wherein said drag means is a parasol-type drogue.

21. A system as defined in claim 20, wherein said parasol-type drogue is comprised of ribs hinged from a rigid body and flexible material taut between said ribs when fully extended to a position substantially normal to the axis of said rigid body, a spring connected to each rib to force the rib to pivot away from said rigid body once said telemetering unit exits said deployment case, and means for preventing each of said ribs from pivoting away from said surface of said telemetering unit more than about 90°.

22. A system as defined in claim 21 wherein at least some of said ribs are provided at the inner ends thereof with means for latching onto said cable dispensing means until extending at least partially to said fully extended position.

23. A system as defined in claim 14 wherein said drag means is a buoyant body.

24. A system as defined in claim 23 wherein said buoyant body is connected to a rigid body, and said sensor connecting cable is connected to said rigid body, and wherein said means for coupling said drag means to said cable dispensing means while in said deployment case is comprised of a plurality of flexible lines connected to said cable dispensing means and extending along the sides of said buoyant body and rigid body, each line terminating with a bead too large to slip between said rigid body and said deployment case, whereby extracting said cable dispensing means from said deployment case extracts said buoyant body and rigid body.

25. A system as defined in claim 23 wherein, said buoyant body is connected to a rigid body, and said sensor connecting cable is connected to said rigid body, and wherein said means for coupling said drag means to said cable dispensing means while in said deployment case is comprised of a plurality of curved springs attached to said cable dispensing means, said springs extending flat along side of said buoyant body and rigid body while stowed in said deployment case, and said springs being turned in underneath said rigid body while flat against said buoyant body and rigid body, whereby extracting said cable dispensing means from said deployment case extracts said buoyant body and rigid body.

* * * * *